United States Patent [19]

Kadera et al.

[11] 4,009,969

[45] Mar. 1, 1977

[54] SUPPORTING RING FOR STATOR VANES IN AN AXIAL COMPRESSOR

[75] Inventors: Vaclav Kadera; Jiri Penkava; Miloslav Vondruska, all of Prague, Czechoslovakia

[73] Assignee: CKD Praha, oborovy podnik, Prague, Czechoslovakia

[22] Filed: Sept. 26, 1975

[21] Appl. No.: 617,192

[30] Foreign Application Priority Data

Sept. 26, 1974 Czechoslovakia ..... 6617/74

[52] U.S. Cl. ..... 415/217

[51] Int. Cl.[2] ..... F01D 1/02

[58] Field of Search ..... 415/216, 217, 32; 416/207, 214

[56] References Cited

UNITED STATES PATENTS

| | | | |
|---|---|---|---|
| 841,503 | 1/1907 | Gelpke | 415/117 |
| 2,382,535 | 8/1945 | Bauer | 416/207 |
| 2,573,875 | 11/1951 | Riddiford | 416/214 |

FOREIGN PATENTS OR APPLICATIONS

| | | | |
|---|---|---|---|
| 461,307 | 6/1928 | Germany | 415/217 |

*Primary Examiner*—Henry F. Raduazo

[57] ABSTRACT

A supporting ring for stator vanes in an axial compressor. The supporting ring permits an adjustment of the angular position of the stator vanes. The adjustment is carried out by removing the stator body while the machine is at standstill. The supporting ring is provided with recesses which are defined by an elastic wall which also defines the bores in which the stator vanes are mounted. Clamping bolts are provided in the elastic wall and by tightening these clamping bolts the stator vanes are held in a predetermined position.

6 Claims, 3 Drawing Figures

SUPPORTING RING FOR STATOR VANES IN AN AXIAL COMPRESSOR

The invention relates to a supporting ring in which the stator vanes of an axial compressor are adapted to be mounted. The stator vanes are mounted in this supporting ring along a circular row. The angular position of the vanes can be adjusted after removal of this supporting ring when the compressor is inoperative and at standstill.

Axial compressors, having angularly adjustable stator vanes whose positions can be adjusted at standstill of the compressor are generally known. The working conditions of these compressors remain for a considerable time unchanged or change only a little and therefore the necessary adjustment in operating conditions can be carried out by means of some commonly used regulating method. For example, the necessary adjustment can be carried out by changing the rotation speed, by throttling at the suction side and similar means. Similar types of compressors are used where the application of expensive arrangements for adjusting the angular position of the vanes in the course of operation would not be economically feasible. The majority of axial compressors wherein the position of the stator vanes can be adjusted require an independent unit for supporting the stator vanes. In these known arrangements the supports of stator vanes are accommodated in a recess inside the stator case, which determines together with the rotor the flow-through space of the compressor. The supports for stator vanes are composed of horizontally divided supporting rings, with radial bores for receiving studs of the adjustable vanes along the whole circumference at regular intervals. Other known arrangements of supports for stator vanes have supporting rings composed of four closely fitted parts connected by bolts. The main drawback of this known arrangement is that after removal of the supports for stator vanes from the compressor and after loosening the bolts of the supporting rings in order to adjust the angular position of the vanes for different working conditions, deformations of these interfitting four parts of the supporting ring occur due to heat stress of the machine. The operating temperature of the compressor may be as high as 350° C. After the compressor cools down a non-uniform deformation of the individual released parts of the supporting rings may occur. The necessary difficult adjustment and fitting prolongs the reassembling of the supports for the stator vanes into the compressor.

SUMMARY OF THE INVENTION

It is a general object of this invention to eliminate this drawback and to provide a supporting ring for stator vanes of compressors which can be easily reassembled and which is of a simple construction and is less expensive to manufacture. The support structure for the stator vanes according to this invention comprises a cylindrical fin and a ring, in which an elastic radial wall is formed by a first recess extending radially from the outer annular periphery of the support ring to the level of the external diameter of the cylindrical fin and by a second recess in the radial wall of suitable diameter extending along the cylindrical fin. Studs of stator vanes are mounted in radial bores of the ring and are clampingly held therein by transverse bolts mounted in the elastic radial wall, mounted between adjacent radial bores. The stator vanes are adjustable by turning the studs in the support ring to the required angular position after loosening the transverse bolts. The position of the stator vanes is secured from the radially inner side by a collar and from the radially outer side by a snap ring.

An advantage of the support ring for stator vanes, according to this invention when compared with the state of the art is above all a substantial simplification in manufacture. This is due to the smaller number of required components of this support ring and by virtue of their simple operating characteristics. The assembling of the support ring for the stator vanes which is of unitary construction in each half of the stator case is also considerably easier than the assembling of two pieces. The smaller number of components of the support ring for stator vanes improves the reliability of operation of the compressor. The laborious and frequently very difficult fitting together of halves of the support ring after previously dismantling them from the compressor for a new adjustment of the stator vanes is thus eliminated. The correct adjustment of the stator vanes to the required angular position is made extremely simple.

DESCRIPTION OF THE DRAWINGS

An examplary embodiment of the invention is shown in the attached drawing, where.

DESCRIPTION OF PREFERRED EMBODIMENT

Figure 1:
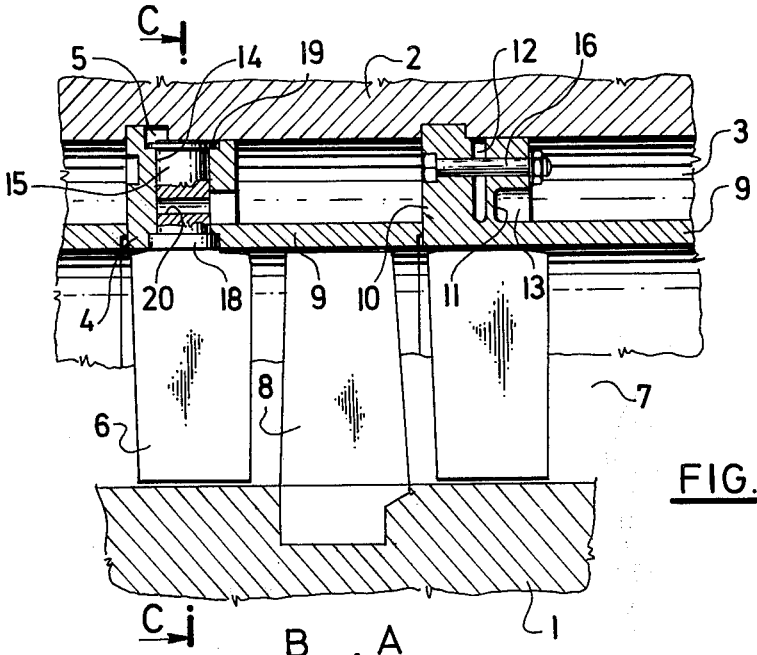
FIG. 1 are sectional elevations of a portion of the stator case and of the rotor of a compressor along the lines indicated in FIG. 2 by A—A and B—B.
Figure 2:
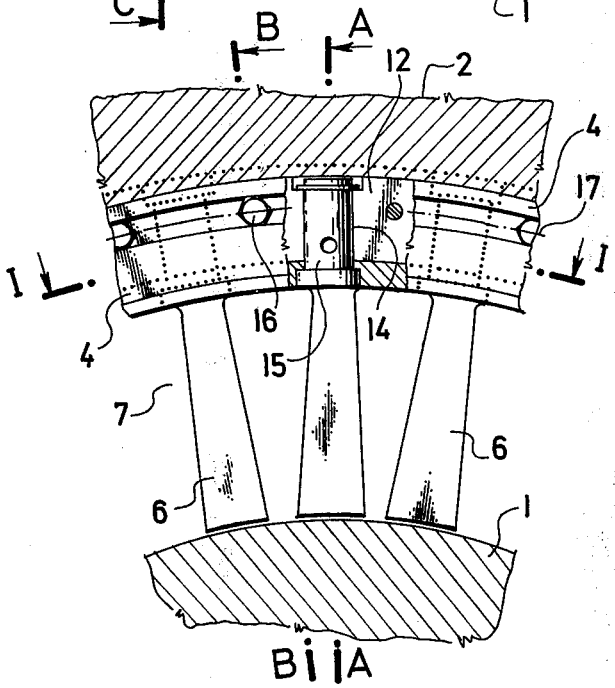
FIG. 2 is a partial front elevational view and a section along a plane, indicated in FIG. 1 by line C—C.
Figure 3:
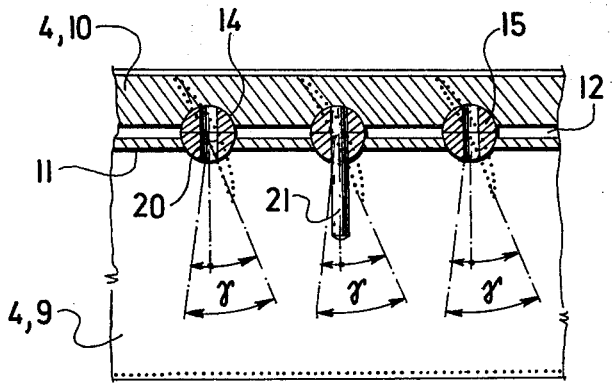
FIG. 3 is a partially developed sectional view of the stator case taken along a curved line indicated in FIG. 2 by line I—I.

The part of the axial compressor as shown in FIG. 1 is composed of a rotor 1 and of a horizontally divided stator case 2. A longitudinal annular recess 3 is provided at the inside of the stator case 2 wherein individual supporting rings of the support structure for stator vanes are mounted and secured against axial displacement by radial recesses 5. Stator vanes 6 are adjustably mounted in circular rows in the supporting rings 4 (see FIG. 2) and extend into the through-flow space 7 jointly with the rotor vanes 8 (see FIG. 1). The supporting ring 4 has a profile of the shape of an "L" in cross section and comprises a cylindrical fin 9 and a ring 10. An elastic radial wall 11 extends from the fin 9 and is formed by a radial recess 12 which extends from the outside in the radial direction along the whole circumference up to the level of the external diameter of the cylindrical fin 9 and by a recess 13 which extends parallel to the compressor axis from the front side along the external diameter of the cylindrical fin 9. A plurality of equidistant cylindrical radial bores 14 for studs 15 of stator vanes 6 are located in the ring 10, with the axes of these bores 14 coinciding with the radial axis of the recess 12. The studs 15 are clampingly held in the ring 4 by transverse bolts 16 pressing radial wall 11 towards ring 10. The clamping bolts 16 are mounted between the studs 15 on a circle 17 (FIG. 2) along the whole circumference of the supporting ring 4. The stator vanes 6 are secured radially inwardly, in the supporting ring 4 of the support structure for stator vanes of the cylindrical radial bore 14 by means of a collar 18 and radially outwardly by means of a safety ring 19 freely rotatable on the stud 15 of the stator vane 6. The studs 15 of the stator vanes 6 are provided with a transverse bore 20 into which an adjustment pin 21 can be inserted (see FIG. 3). The stator vanes 6 are adjustable within a useful angular limit $\gamma$.

The adjustment of the angular position of stator vanes 6 is performed at standstill of the machine after removal of the supporting structure of the stator vanes from the stator case when changes in working conditions of the compressor are necessary for longer time intervals. By releasing the transverse bolts 16 the pressure on the studs 15 of the stator vanes 6 is reduced, so that they can be easily turned. The required adjustment is accomplished by an adjustment pin 21, one end of which is inserted into the transverse bore 20 of the stud 15; the second end of the pin 21 serves for measuring the angular position which is adjusted with respect to the face of the ring 10 of the supporting ring 4 by a not shown measuring device. After adjustment of the stator vanes 6 their studs 15 are again clamped in the ring 10 by the transverse bolts 16, the heads of which are guided in a circular recess (see FIG. 1) and the nuts of which are secured against loosening. The supporting structure for the stator vanes 6 is thereafter mounted into the stator case 2.

Although the invention is illustrated and described with reference to one preferred embodiment thereof, it is to be expressly understood that it is no way limited to the disclosure of such a preferred embodiment, but is capable of numerous modifications within the scope of the appended claims.

What is claimed is:

1. A support structure for stator vanes of an axial compressor adapted to be mounted in the stator case of the compressor, comprising in combination, at least one supporting ring having a plurality of bores located along a row on a circumference of said ring, and at least one first annular recess traversing said plurality of bores in said ring;

a plurality of studs adjustably mounted in said bores and having stator vanes extending therefrom into the flow-through space of the compressor, said first annular recess forming elastic wall means in said supporting ring for clampingly supporting said studs in said supporting ring, said supporting ring having a ring portion and a cylindrical fin portion, said annular recess extending radially inwardly from the radially outer periphery of said ring portion to the radially outer periphery of said cylindrical fin portion, and said ring portion having a second annular recess which extends parallel to the axis of the compressor and having a diameter corresponding substantially to the radial thickness of said cylindrical fin portion.

2. The support structure as set forth in claim 1, including a plurality of transverse clamping bolts operatively mounted in said elastic wall means for clampingly holding said studs in said bores.

3. The support structure as set forth in claim 1, wherein safety rings are mounted on said studs for securing them against radially inward motions and collars are mounted on said studs for securing them against radially outward motions.

4. The support structure as set forth in claim 1, wherein said bores extend radially in said supporting ring.

5. The support structure as set forth in claim 1, wherein said studs have transverse bores adapted to receive adjusting pins for adjusting and indicating the angular position of the stator vane in the compressor.

6. The support structure as set forth in claim 1, wherein said plurality of bores are equidistantly spaced from each other.

* * * * *